US005606640A

United States Patent [19]

Murphy

[11] Patent Number: 5,606,640

[45] Date of Patent: Feb. 25, 1997

[54] TOWEL WARMING CABINET WITH HEATED AIR FROM ATTACHED HAIR DRYER CIRCULATING THROUGH TOWEL RACK AND DOWNWARDLY OVER THE TOWEL

[76] Inventor: Willard J. Murphy, 611 S. 22nd St., St. Cloud, Minn. 56301

[21] Appl. No.: 561,408

[22] Filed: Nov. 21, 1995

[51] Int. Cl.[6] ..... H05B 3/02; F26B 9/00

[52] U.S. Cl. ..... 392/382; 219/521; 34/621; 34/231; 34/91; 392/385

[58] Field of Search ..... 392/379, 382, 392/383, 385; 219/521, 385, 400; 34/619, 621, 622, 202, 231, 239, 91, 90; 223/51

[56] References Cited

U.S. PATENT DOCUMENTS

| | | | |
|---|---|---|---|
| Re. 32,616 | 3/1988 | Graham . | |
| 2,668,368 | 2/1954 | Jacobs . | |
| 2,835,049 | 5/1958 | Jacobs . | |
| 3,299,529 | 1/1967 | Roberts et al. | 34/91 |
| 3,518,776 | 7/1970 | Wolff et al. | 34/91 |
| 3,563,460 | 2/1971 | Nine | 34/491 |
| 3,849,629 | 11/1974 | Graham, Jr. . | |
| 4,094,076 | 6/1978 | Baslow . | |
| 4,108,242 | 8/1978 | Searight et al. . | |
| 4,117,309 | 9/1978 | Cayley . | |
| 4,199,873 | 4/1980 | Hansen et al. . | |
| 4,205,460 | 6/1980 | Taylor . | |
| 4,336,443 | 6/1982 | Benedetto | 219/400 |
| 4,412,392 | 11/1983 | Keller . | |
| 4,625,432 | 12/1986 | Baltes . | |
| 4,694,146 | 9/1987 | DeMars . | |
| 4,737,616 | 4/1988 | Wen-Ying | 392/365 |
| 4,849,610 | 7/1989 | Alvarez . | |
| 5,003,707 | 4/1991 | Chu | 34/523 |
| 5,014,446 | 5/1991 | Reesman . | |
| 5,379,525 | 1/1995 | Raynor | 34/239 |
| 5,443,538 | 8/1995 | Little | 34/91 |

FOREIGN PATENT DOCUMENTS

| | | |
|---|---|---|
| 48835 | 5/1974 | Australia . |
| 550498 | 9/1956 | Belgium . |
| 54-108964 | 8/1979 | Japan . |
| 1428107 | 3/1976 | United Kingdom . |

*Primary Examiner*—John A. Jeffery

*Attorney, Agent, or Firm*—Andrus, Sceales, Starke and Sawall

[57] ABSTRACT

An apparatus for warming a towel or other article includes a cabinet having an open top and closed by hinged lid and a hollow rack is mounted within the cabinet. A towel to be warmed is draped over the rack. A portion of heated air is introduced through a conduit into one end of the rack and is discharged outwardly from the rack through a plurality of outlets into contact with the inner surface of the draped towel, while a second portion of heated air is directed upwardly by a baffle to the upper end of the cabinet and then downwardly along the outer surface of the towel. In the preferred form of the invention, air is supplied to the rack by a standard hair dryer, the outlet of which is connected to an end of the rack by a locking mechanism. The electric plug connected to the hair dryer cord is engaged with socket mounted on the cabinet and a thermostatic control is associated with the socket and acts to open the electrical circuit to the socket if the temperature in the cabinet exceeds a preselected upper limit.

5 Claims, 3 Drawing Sheets

FIG. 1
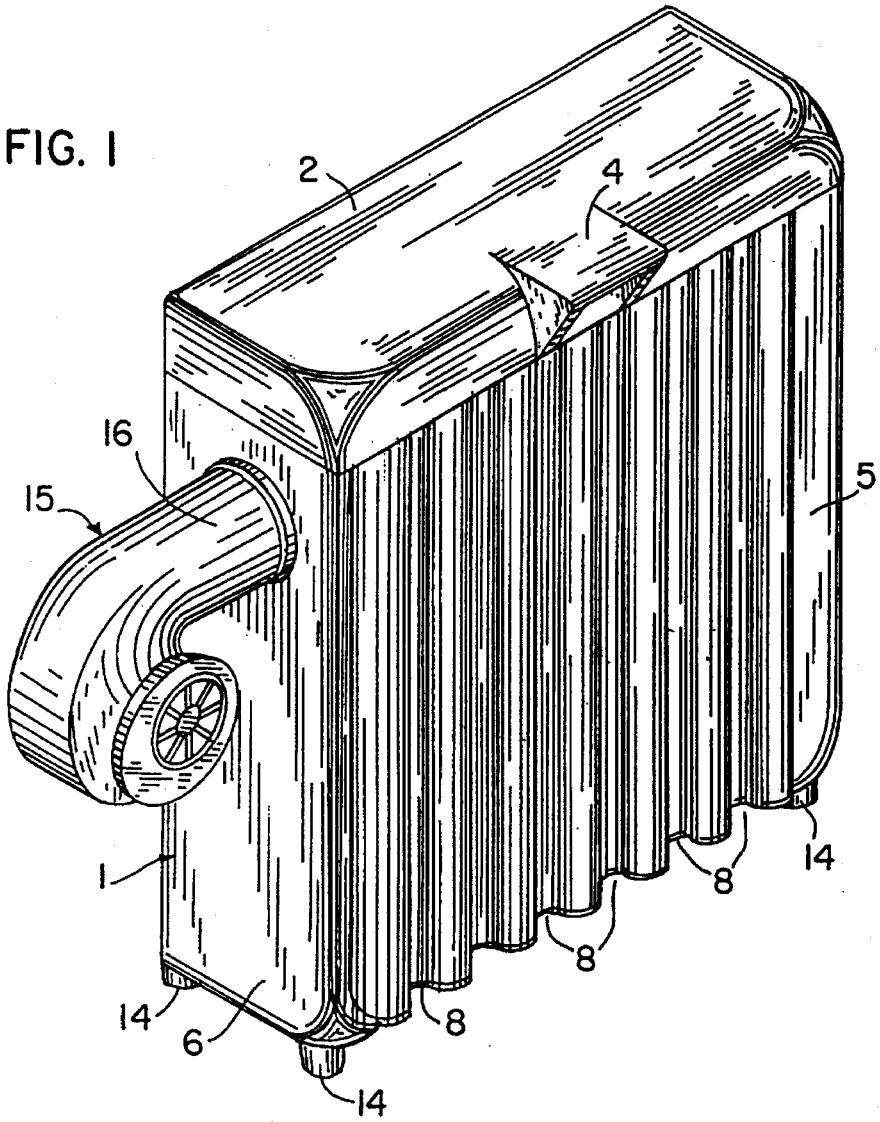
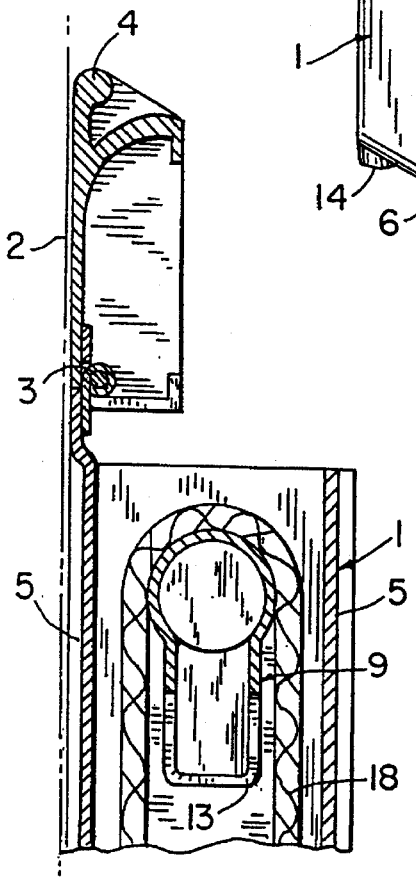
FIG. 3

FIG. 6
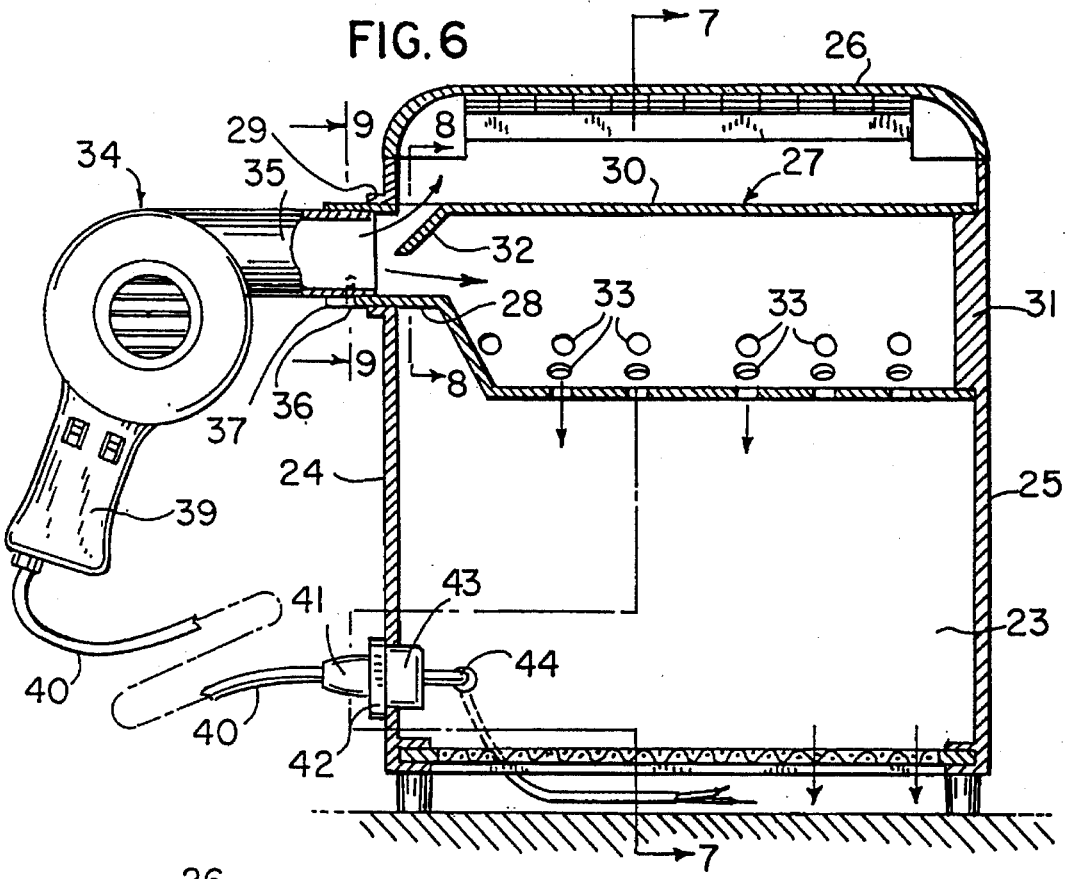
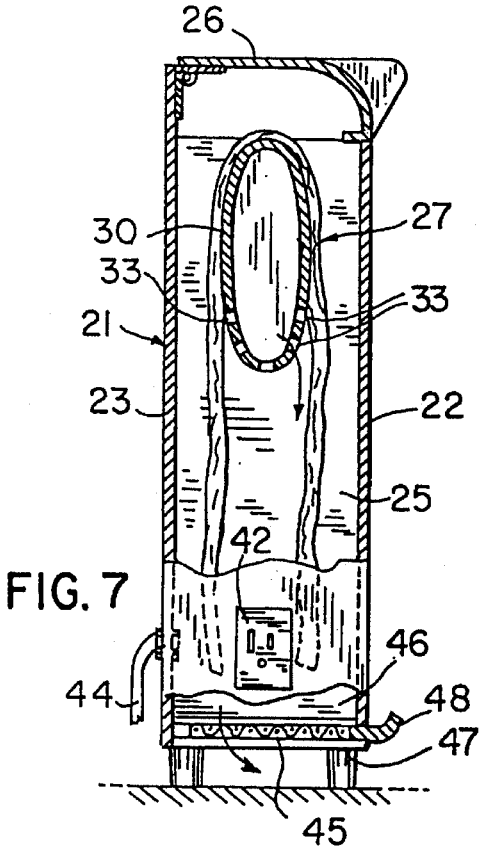
FIG. 7
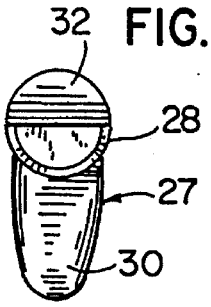
FIG. 8
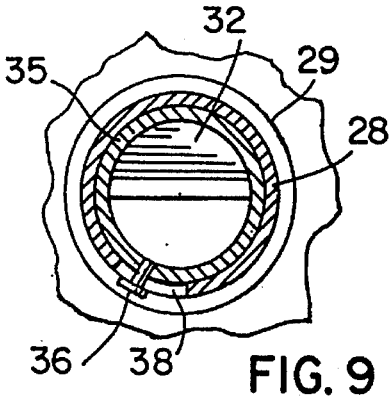
FIG. 9

TOWEL WARMING CABINET WITH HEATED AIR FROM ATTACHED HAIR DRYER CIRCULATING THROUGH TOWEL RACK AND DOWNWARDLY OVER THE TOWEL

BACKGROUND OF THE INVENTION

Hotels, motels and bed-and-breakfasts are constantly seeking a product to meet the commercial market needs and provide a competitive edge. One product for creating a competitive edge is a towel warmer that is used to warm a towel in a relatively short period of time. Various types of towel warmers have been proposed in the past. For example, U.S. Pat. No. 3,849,629 describes a towel warmer which is adapted to be suspended from a towel bar or other support and includes an electrical heating element which is mounted on the inner surface of a removable door in the bottom of the cabinet.

U.S. Pat. No. 4,117,309 discloses an electric towel warmer including an inverted, U-shaped rack which extends upwardly from the bottom of the cabinet or housing and is adapted to support a towel to be warmed. An electric heating element having a sinuous configuration is mounted within the perforated rack. U.S. Pat. No. 4,694,146 describes a towel warmer having a cabinet formed of a pair of hinged sections. An electric heating element is located between the two sections of the cabinet and is covered by a fiber glass screen which acts to protect the towel support and the heating elements.

U.S. Pat. No. 4,849,610 shows a towel rack including a plurality of spaced parallel racks for supporting towels and heating elements located on either side of the heating chamber.

U.S. Pat. No. 5,014,446 shows a towel warmer which incorporates a standard hair dryer. The outlet of the hair dryer is received within an opening in the lower end of the cabinet, and the heated air passes upwardly through a towel supported on a perforated divider shelf, with the air being vented through openings in the lid of the cabinet.

SUMMARY OF THE INVENTION

The invention is directed to an improved towel warmer which is compact in size and has improved heating efficiency.

In accordance with the invention, the towel warmer includes a cabinet or housing having an open top which is enclosed by a hinged lid. A hollow rack is mounted within the upper portion of the cabinet and a towel to be heated is draped over the rack.

Heated air is introduced through a conduit into one end of the rack and discharged through outlet openings in the rack into contact with the inner surface of the draped towel. In addition, a baffle is incorporated at the inlet of the rack and serves to direct a portion of the heated air upwardly and over the outer surface of the towel. The side walls of the cabinet can be formed with a plurality of vertical corrugations or flutes which provide channels for the flow of heated air downwardly along the outer surface of the towel.

In a preferred form of the invention, the heated air is supplied to the rack through use of a standard portable electric hair dryer. In this embodiment the outlet of the hair dryer is connected to an end of the rack so that the heated air from the hair dryer is distributed into the hollow rack as well as outwardly around the towel by virtue of the baffle.

Suitable vents can be provided in the bottom of the cabinet for discharge of the heated air.

Due to the use of the heated air and the construction of the cabinet and rack, both the inner and outer surfaces of the towel are heated, thereby increasing the efficiency of the heating operation and enabling a towel to be warmed in a period of about three minutes.

The warmer of the invention is simple in construction and compact in size so that it occupies limited space. The towel warmer can be designed to be either free standing or wall mounted.

As a feature of the invention, a combination electrical socket and thermostatic control can be mounted on a wall of the cabinet. The socket, which is pre-wired to the electrical circuit of the building, is intended to receive the male plug of the electrical hair dryer, while the thermostatic control is responsive to a preselected temperature within the cabinet, and will act to open the circuit between the electrical socket and the power supply if the temperature in the cabinet rises above the preselected value, thus preventing overheating and possible damage to the components of the towel warmer. This feature is important when utilizing a standard electric portable hair dryer, which normally includes several temperature settings. If in use, the high temperature setting is employed for extended periods of time, overheating may occur. Thus, the thermostatic control will prevent overheating and possible damage to the components of the towel warmer, particularly if the towel warmer includes plastic components.

As a further feature of the invention, a locking mechanism is employed to lock the outlet conduit of the hair dryer to the inlet of the rack in the cabinet. It has been found that the vibration caused by operation of the hair dryer may tend to loosen the connection between the hair dryer and the rack. Thus, the locking mechanism will maintain the hair dryer in tight engagement with the inlet of the rack.

In a preferred form of the invention, the locking mechanism may take the form of a pin on the outlet end of the hair dryer, which is slidable within a longitudinal slot in the inlet end of the rack. The inner end of the longitudinal slot communicates with a circumferential slot, and by inserting the pin into the longitudinal slot and then rotating the hair dryer, the pin will enter the circumferential slot to lock the hair dryer to the cabinet.

The towel warmer of the invention also preferably includes a lint filter, which is located adjacent the outlet or vent in the cabinet. The filter is preferably made of plastic material, and is slidable on guides formed on the inner surface of the cabinet, so that the filter can be periodically removed from the cabinet and cleaned. The filter will prevent lint from the towels or other articles from blowing from the cabinet into the bathroom.

Other objects and advantages will appear during the course of the following description.

DESCRIPTION OF THE DRAWINGS

The drawings illustrate the best mode presently contemplated of carrying out the invention.

In the drawings:

FIG. 1 is a perspective view of the towel warmer of the invention;

FIG. 3 is a section taken along line 3—3 of FIG. 2;

FIG. 6 is a vertical section of a modified form of the towel warmer of the invention;

FIG. 7 is a section taken along line 7—7 of FIG. 6;

FIG. 8 is a section taken along line 8—8 of FIG. 6; and

FIG. 9 is a section taken along line 9—9 of FIG. 6.

DESCRIPTION OF THE ILLUSTRATED EMBODIMENT

Figure 2:
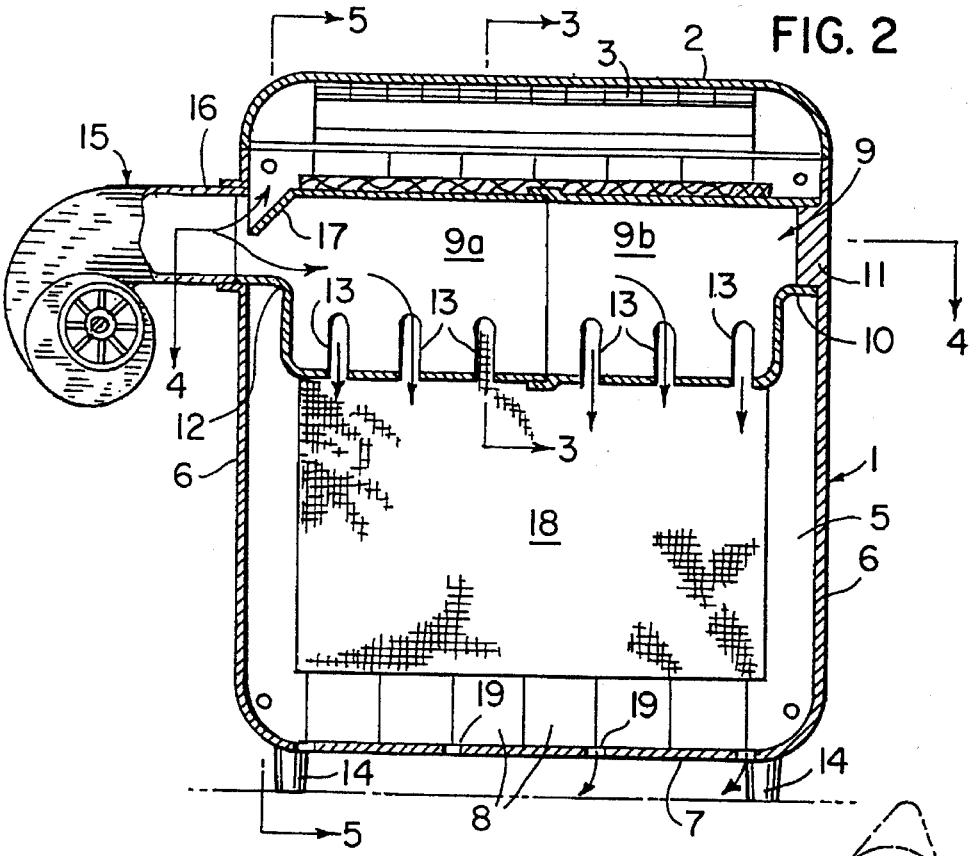
FIG. 2 is a vertical section of the towel warmer shown in FIG. 1.

FIGS. 1–5 illustrate a towel warmer including an open top cabinet or housing 1, and a cover 2 is hinged to the upper edge of cabinet 1 through hinge 3 and is movable between a closed and open position. A finger tab 4 is provided on the cover to enable the cover to be readily grasped by the operator.

Figure 4:
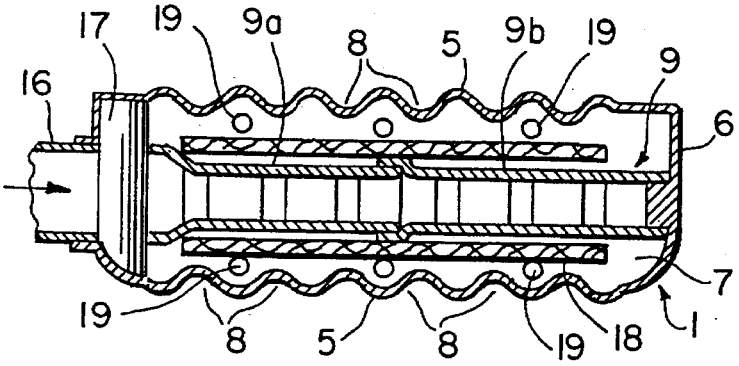
FIG. 4 is a section taken along line 4—4 of FIG. 2.

Cabinet 1 includes a pair of opposed side walls 5 connected by end walls 6. The bottom edges of side walls 5 and ends walls 6 are connected by a bottom wall 7. As best shown in FIGS. 1 and 4, side walls 5 can be each provided with a plurality of vertical parallel flutes or corrugations 8.

Mounted within cabinet 1 is a tubular rack or towel support 9. One end 10 of the rack is engaged with a projection 11 extending inwardly from one of the side walls 5, as illustrated in FIG. 2, while the opposite end 12 of the rack extends outwardly through an opening in the opposite side wall 5. Rack 9 is preferably formed of two end-to-end sections **9*a* and 9*b*. As shown in FIG. 4, one end of rack section 9*b* is enlarged and receives the aligned end of the rack section 9*a***.

Formed in the lower portion of rack 9 are a plurality of discharge slots 13.

Cabinet 1 can either be free standing or wall mounted. With a free standing model, as shown in FIGS. 1–5, legs 14 extend downwardly from the cabinet to support the cabinet from a suitable surface.

In the embodiment of FIGS. 1–5, heated air is introduced into the end 12 of rack 9 through use of a standard hair dryer 15. The outlet end 16 of the hair dryer is mounted in the opening in side wall 5 through a press fit or other suitable connection. Heated air from the hair dryer 15 will be discharged into the rack 9.

As shown in FIG. 2, the inlet end of the rack is formed with a diagonal baffle 17 so that a portion of the air entering the end 12 of the rack will be directed upwardly toward the cover 2 and then flow downwardly around the sides of the rack.

Figure 5:
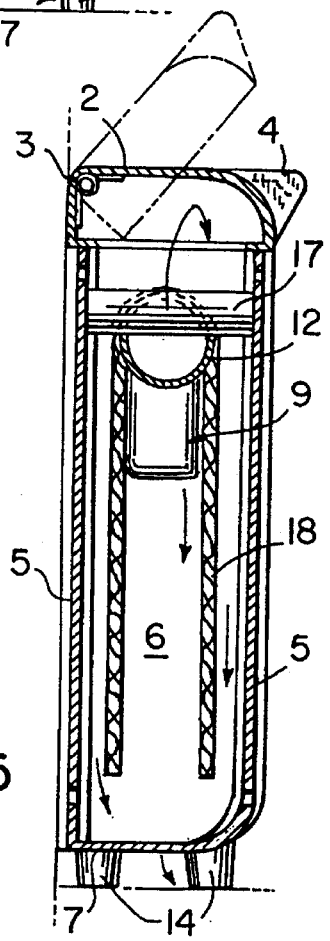
FIG. 5 is a section taken along line 5—5 of FIG. 2.

A towel 18 to be warmed is draped over the rack with the side portions of the towel being in spaced relation to each other, as shown in FIG. 5. The heated air entering rack 9 will be discharged through slots 13 into contact with the inner surface of the towel while the portion of the air being directed upwardly by baffle 17 will flow downwardly along the outer surface of the towel as shown in FIG. 5. Thus both surfaces of the towel will be warmed by the heated air.

The air is discharged from the lower end of cabinet 1 through a series of vent holes 19.

The corrugations or flutes 8 in the side walls provide vertical channels so even if the towel is engaged with the side walls, the air can flow downwardly through the channels defined by the flutes.

With the construction of the invention, both the inner and outer surfaces of the towel are heated or warmed, and due to the efficiency of the operation, a large bath towel can be warmed in a period of approximately three minutes.

As a further advantage, the unit is compact in size and can be either wall mounted or can rest on a counter or sink.

FIGS. 6–9 illustrate a modified form of the invention. The towel warmer of FIGS. 6–9 includes an open top cabinet 21 including a front wall 22, a rear wall 23, and a pair of end walls 24 and 25. As shown in FIGS. 6 and 7, the front and rear walls 22 and 23 are smooth and without flutes, such as shown in the first embodiment, although flutes can be utilized if desired.

The open upper end of the cabinet 21 is enclosed by a hinged lid 26, similar to lid 23 of the first embodiment.

In this embodiment, the bottom of the cabinet is open, although alternately, the lower end of the cabinet can be enclosed by a wall having vent holes as described in the first embodiment.

Mounted horizontally across the upper end of cabinet 21 is a hollow rack 27. Rack 27 includes a generally cylindrical inlet section 28, which projects outwardly of the cabinet through a flanged opening 29 in end wall 24. Rack 27 also includes a generally oval section 30, which is elongated in a vertical direction and is located within the cabinet. The inner end of the oval section is engaged with an oval plug 31 extending inwardly from the end wall 25.

As in the case of the first embodiment, rack 27 is provided with an inclined baffle 32, which is located adjacent inlet section 28. As shown in FIG. 6, baffle 32 extends downwardly at an angle toward the axis of the rack and acts to deflect a portion of the air entering inlet section 28 upwardly into the upper portion of the rack, and the air will then flow downwardly along the outer surface of the towel that is supported on the rack.

The lower portion of oval section 30 is formed with a plurality of outlet ports or openings 33, and the heated air in the section 30 of rack 27 will be discharged through the ports 33 into engagement with the inner surface of the towel that is draped over the rack. Thus, heated air will be distributed not only along the outer surface of the towel, but along the inner surface.

As shown in FIG. 6, heated air is supplied to the inlet section 28 of rack 27 by a portable electric hair dryer 34. The tubular outlet end 35 of the hair dryer is telescopically received within the inlet end 28 of the rack. It has been found that vibration caused by operation of hair dryer 34 can cause the outlet end 35 to be disengaged from inlet section 28. Thus, a locking mechanism is incorporated, which preferably can take the form of a pin 36, which extends outwardly from outlet end 35 and can be inserted within a longitudinal slot 37 formed in the inlet section 28. A circumferential slot 38 extending through an arc of about 15° to 20° communicates with the inner end of slot 37, and when pin 36 bottoms out in longitudinal slot 37 the hair dryer can be rotated, causing the pin 36 to enter the circumferential slot 38. This will lock the hair dryer to the towel warmer and prevent vibration from separating the hair dryer from the cabinet 21.

Hair dryer 34 is a standard type and includes a handle portion 39. An electrical cord 40 extends outwardly from handle portion 39 and terminates in a standard electric male plug 41, that can be engaged with an electric socket or receptacle 42, mounted on end wall 24. Socket 42 is preferably formed integrally with a thermostatic control indicated by 43. The thermostatical control is a standard type, being responsive to an preselected elevated temperature in cabinet 21, and is connected through electrical leads 44 to a suitable source of power. If the temperature exceeds this preselected value, the thermostatic control will operate to open the circuit between the electrical power source and socket 42, thus terminating the operation of hair dryer 34. The use of the thermostatic control is important when utilizing a standard electric hair dryer, which normally has several heat settings. If the highest setting is utilized for an extended period, it is possible that the cabinet may overheat, causing damage to components of the towel warmer, particularly if such components are made of plastic material.

As a further feature of the invention, a lint filter screen 45 is mounted in cabinet 21 immediately above the open bottom of the cabinet. Filter 45 is removable from the cabinet and in this regard, the filter can be inserted into the cabinet through a slot formed in front wall 22. The filter is slidable in guideways each formed by a pair of guides 46 and 47 mounted on the end walls 24 and 25. The outer end 48 of the filter screen 44 projects beyond the front wall 22 to a location where it can be grasped by the user for removal of the filter. The filter prevents lint from the towels or other articles from escaping from the cabinet into the bathroom or other room of the building.

Various modes of carrying out the invention are contemplated as being within the scope of the following claims, particularly pointing out and distinctly claiming the subject matter which is regarded as the invention.

I claim:

1. An apparatus for warming articles such as a towel, comprising an outer cabinet including a pair of generally parallel side walls and a pair of end walls connecting said side walls together, a tubular rack extending generally horizontally between said end walls, said rack having an inlet end extending through one of said end walls, air supply means for supplying heated air to the inlet end of the rack, baffle means located adjacent said inlet end and extending inwardly of said rack for directing a portion of said heated air into an upper portion of said cabinet above said rack and for directing a second portion of said heated air into said rack, said article being draped over the rack with opposite sides of said article extending downwardly over the rack in spaced parallel relation, port means in the rack for discharging heated air from the rack into contact with the inner surface of the article draped on the rack, said second portion of the heated air flowing downwardly across the outer surface of said article, and vent means located in the lower portion of said cabinet for venting air from said cabinet, said rack including an upper tubular section and a lower tubular section communicating with said upper section, said upper tubular section having a greater horizontal width than the lower tubular section, said port means being disposed in said lower section, said article being spaced laterally from said port means, whereby heated air can freely be discharged from said port means into contact with the inner surface of said article.

2. The apparatus of claim 1, wherein said air supply means comprises an electric hair dryer including a tubular outlet, said tubular outlet being telescopically received with respect to said inlet end, and locking means for locking said outlet to said inlet end.

3. An apparatus for warming articles such as a towel, comprising an outer cabinet including a pair of generally parallel side walls and a pair of end walls connecting said side walls together, a tubular rack extending generally horizontally between said end walls, said rack having an inlet end extending through one of said end walls, air supply means for supplying heated air to the inlet end of the rack, baffle means located adjacent said inlet end and extending inwardly of said rack for directing a portion of said heated air into an upper portion of said cabinet above said rack and for directing a second portion of said heated air into said rack, said article being draped over the rack with opposite sides of said article extending downwardly over the rack in spaced parallel relation, port means in the lower portion of the rack for discharging heated air from the rack into contact with the inner surface of the article draped on the rack, said second portion of the heated air flowing downwardly across the outer surface of said article, and vent means located in the lower portion of said cabinet for venting air from said cabinet, said rack including an inlet section that defines said inlet end and having a generally cylindrical cross-section, said rack also includes a generally oval section connected to said inlet section, said oval section being elongated in a vertical direction, said port means being disposed in the lower portion of said oval section.

4. An apparatus for warming articles such as a towel, comprising an outer cabinet including a pair of generally parallel side walls and a pair of end walls connecting said side walls together, a tubular rack extending generally horizontally between said end walls, one of said end walls having an opening therein and said rack having an inlet end aligned with said opening, an electric hair dryer having a tubular discharge outlet received within said opening in the end wall and communicating with the inlet end of said rack whereby operation of said dryer will discharge a first portion of heated air into said rack, baffle means located adjacent said inlet end for directing a second portion of the heated air into an upper portion of said cabinet above said rack, said article being draped over the rack with opposite sides of said article extending downwardly over the rack in spaced parallel relation, port means in the rack for discharging heated air from the rack into contact with the inner surface of the article draped on the rack, said second portion of the heated air flowing downwardly across the outer surface of said article, vent means located in the lower portion of said cabinet for venting air from said cabinet, said electric hair dryer including an electrical cord terminating in a plug having a plurality of prongs, and an electrical socket disposed on said cabinet and having a plurality of receptacles to receive the prongs on said plug, said socket being connected in an electrical circuit with an electrical power supply.

5. The apparatus of claim 1, and including thermostatic control means associated with said socket, said thermostatic control means being responsive to a preselected elevated temperature in said cabinet to open the circuit from said power supply to said socket.

* * * * *

UNITED STATES PATENT AND TRADEMARK OFFICE

CERTIFICATE OF CORRECTION

PATENT NO. : 5,606,640

DATED : February 25, 1997

INVENTOR(S) : WILLARD J. MURPHY

It is certified that error appears in the above-indentified patent and that said Letters Patent is hereby corrected as shown below:

Line 52, CLAIM 5, Cancel "1" and substitute therefor ---4---

Signed and Sealed this

Twenty-fifth Day of November, 1997

*Attest:*

*Attesting Officer*

BRUCE LEHMAN

*Commissioner of Patents and Trademarks*